United States Patent [19]

Strik

[11] 4,032,342

[45] June 28, 1977

[54] METHOD OF MANUFACTURING A CATHODE RAY TUBE FOR DISPLAYING COLORED PICTURES AND CATHODE RAY TUBE MANUFACTURED ACCORDING TO SAID METHOD

[75] Inventor: Francis Bernardus Strik, Eindhoven, Netherlands

[73] Assignee: U.S. Philips Corporation, New York, N.Y.

[22] Filed: Aug. 24, 1976

[21] Appl. No.: 717,195

[30] Foreign Application Priority Data

Sept. 1, 1975 Netherlands ..... 7510272

[52] U.S. Cl. ..... 96/36.1; 354/1; 427/68

[51] Int. Cl.[2] ..... G03C 5/00

[58] Field of Search ..... 96/36.1; 354/1; 427/68

[56] References Cited

UNITED STATES PATENTS

| | | | |
|---|---|---|---|
| 3,779,760 | 12/1973 | Miyaoka | 96/36.1 |
| 3,888,673 | 6/1975 | Suzuki et al. | 96/36.1 |

*Primary Examiner*—Edward C. Kimlin
*Attorney, Agent, or Firm*—Frank R. Trifari

[57] ABSTRACT

An exposure method for manufacturing a cathode ray tube for displaying colored pictures and having a display screen comprising a large number of triplets of phosphor lines. During the manufacture of the display screen the phosphor lines are provided on the unexposed areas of a photosensitive layer. In order to obtain good triplets at the edge of the display screen, according to the invention an extra lamp position is used during the exposure.

2 Claims, 5 Drawing Figures

METHOD OF MANUFACTURING A CATHODE RAY TUBE FOR DISPLAYING COLORED PICTURES AND CATHODE RAY TUBE MANUFACTURED ACCORDING TO SAID METHOD

The invention relates to a method of manufacturing a cathode ray tube for displaying coloured pictures and comprising a display screen having a large number of triplets each consisting of three linear areas luminescing in a first, a second and a third colour, respectively, said second colour being present between the first and the third colour, means to generate three electron beams, and a colour selection electrode comprising a large number of substantially parallel slots for assigning each electron beam to luminescent areas of one colour, in which method for providing the luminescent areas of each colour a photosensitive layer is exposed through the colour selection electrode from at least two positions present one on each side of an exposure centre for said colour in such manner that the light beams which pass through two adjacent slots overlap each other on the photosensitive layer and an unexposed area where the luminescent regions of the said colour are provided is formed on the photosensitive layer between the light beams which pass through the same slot. The invention also relates to a cathode ray tube for displaying coloured pictures manufactured according to such a method.

German Offenlegungsschrift No. 2,248,878 discloses a method of manufacturing a cathode ray tube in which a photosensitive layer is exposed through the colour selection electrode from at least two positions in such manner that the light beams which pass through two juxtaposed slots overlap each other on the photosensitive layer and an unexposed area is formed on the photosensitive layer between the light beams which pass through the same slot. In the method disclosed in said Offenlegungsschrift light-absorbing strips separating the linear areas which luminesce in different colours from each other are provided on the said unexposed areas. The use of the exposure method described in the Offenlegungscrift for providing the luminescent areas themselves proves to encounter unexpected difficulties which will be explained in detail hereinafter with reference to a drawing. As a matter of fact, the result of the use of the exposure method described in the Offenlegungsschrift for providing the luminescent areas proves to be that the two outer triplets which in normal operation of the tube are present on the extreme left and on the extreme right at the edge of the display screen do not correctly display the colour. As a result of this the displayed picture has edges which show annoying colour defects.

It is to be noted that a slot in the colour selection electrode is to be understood to mean herein both one uninterrupted slot-like aperture and a row of elongate apertures having narrow bridges between them.

It is the object of the invention to prevent the above-mentioned colour defects.

For that purpose, according to the invention, during the exposure for providing the luminescent areas of the third colour the photosensitive layer is also exposed from substantially the exposure centre for the first colour and during the exposure for providing the luminescent areas of the first colour, the photosensitive layer is also exposed from substantially the exposure centre for the third colour.

A suitable method of providing luminescent material on the unexposed areas of a photosensitive layer is the electrophotographic method disclosed in U.S. Pat. No. Spec. 3,475,169 in which the photosensitive layer is a photoconductive layer which has an electric charge pattern which is developed with a suspension containing electrically charged phosphor particles. In another method, the phosphor is provided in a photosensitive layer which, before exposure, is insoluble in a solvent and after exposure is soluble in the solvent. After exposure through the colour selection electrode the phosphor-containing photosensitive layer is developed with the solvent. These and similar methods are known from the prior art and need no further explanation.

The invention will be described in greater detail with reference to the accompanying drawing, of which:

FIGS. 1 to 5 are more or less schematic figures which show the exposure method in a simplified manner.

Figure 1:
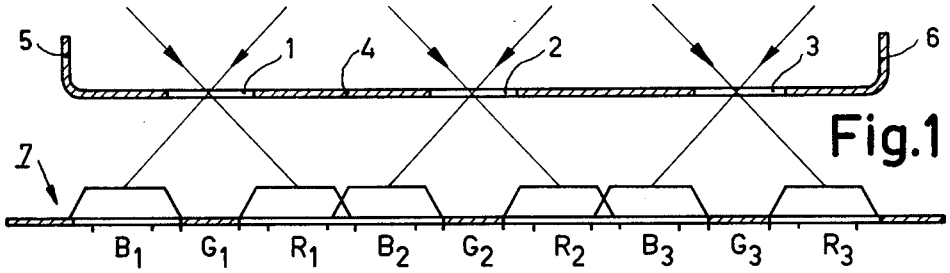
FIGS. 1, 2 and 3 show the known exposure method and also serve to explain the drawbacks of said method.

The colour selection electrode 4, sometimes termed shadow mask, comprises a large number of slots three of which are shown and are referenced 1, 2 and 3. The longitudinal direction of the slots is normal to the plane of the drawing and in normal operation of the tube is vertical. The left-hand edge of the shadow mask 4 is denoted by 5 and the right-hand edge by 6. The slot 1 is the extreme left slot along the left-hand edge 5 of the shadow mask 4. The slot 3 is the extreme right slot along the right-hand edge 6 of the shadow mask 4. Of course, a large number of slots are present between the slots 1 and 3 but only one of them is shown and is referenced 2.

A large number of triplets each consisting of a blue, a green and a red luminescing phosphor line are to be provided on the display screen 7 which is shown diagrammatically in cross-section. The longitudinal direction of the phosphor lines is normal to the plane of the drawing. The phosphor lines associated with slot 1 and the places where said phosphor lines are to be provided, respectively, are denoted by $B_1$, $G_1$ and $R_1$ wherein the index 1 refers to the slot 1 and B, G and R refer to the colours blue, green and red, respectively. Similar indications apply to the slot 2 and the triplet $B_2$, $G_2$, $R_2$, as well as to the slot 3 and to the triplet $B_3$, $G_3$, $R_3$.

A photosensitive layer on the display screen 7 is exposed via the shadow mask 4 so that a pattern of light areas and shadow areas is formed on the photosensitive layer. In the development succeeding the exposure the phosphor is always deposited on the shadow areas. The light areas on the photosensitive layer are denoted in FIGS. 1 to 6 by means of a trapezoidal light distribution on the relevant area. The light beam which causes a given light area is denoted diagrammatically by one light ray which connects the centre of a slot in the shadow mask 4 to the centre of the light distribution.

FIG. 1 shows the exposure for providing the green phosphor lines. The direction to the exposure centre for the green phosphor lines is from the centre of a phosphor line G through the centre of the associated slot. It appears from FIG. 1 that exposure is carried out from two positions which are present on the left and on the right of the exposure centre. A shadow area ($G_1$, $G_2$ $G_3$) is formed on the photosensitive layer between the light beams which pass through the same shadow mask aperture. the light beams which pass through juxtaposed apertures overlap each other on the photosensitive layer. See, for example, the overlap between $R_1$ and $B_2$ in FIG. 1. In order to achieve the required overlap, the light sources in the two positions may be slightly moved to and fro, if desired, or they may each consist of two lamps which are positioned at a short distance from each other.

Figure 2:
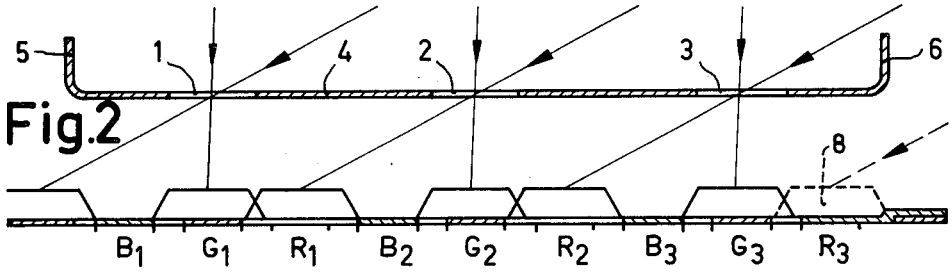
Figure 3:
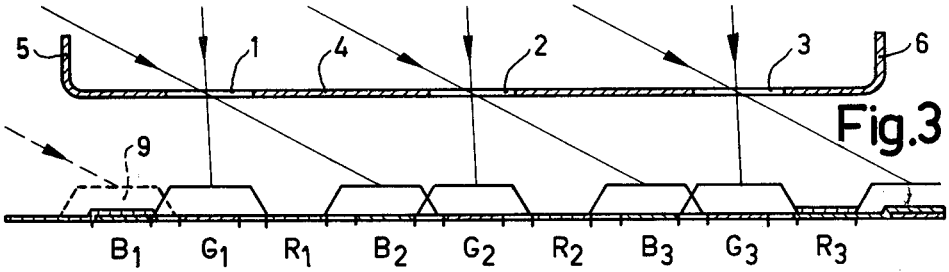

In a quite analogous manner, after the development with green phosphor, the exposure for the blue phosphor lines is carried out, as is shown in FIG. 2, by exposure from two positions which are present on the left and on the right of the exposure centre for the blue phosphor lines and, as shown in FIG. 3, after the development with blue phosphor, the exposure for the red phosphor lines is carried out by exposure from two positions which are present on the left and on the right of the exposure centre for the red phosphor lines. However, the sequence of the colours is not essential.

However, it also appears from FIGS. 2 and 3 that the triplet $B_1$, $G_1$, $R_1$ along the left-hand edge of the display screen and the triplet $B_3$, $G_3$, $R_3$ along the right-hand edge of the display screen cannot readily be provided by means of the prior art exposure. Because as a matter of fact the slot 3 is the extreme right slot in the shadow mask 4, the light distribution 8 denoted by a broken line (FIG. 2) is not present. Nor is the light distribution 9 denoted by a broken line (FIG. 3) present because the slot 1 is the extreme left slot in the shadow mask 4. This has for its result that blue phosphor is provided at the area of $R_3$ (FIG. 2) and red phosphor is provided at the area of $B_1$ (FIG. 3). In other words, the blue phosphor line of the left-hand triplet and the red phosphor line of the right-hand triplet do not correctly display the colour. The displayed picture then shows incorrectly coloured edges, which, however, is prevented by means of an exposure method according to the invention.

The invention will be described in detail with reference to FIG. 4 which should be compared with FIG. 2 and with reference to FIG. 5 which should be compared with FIG. 3.

Figure 4:
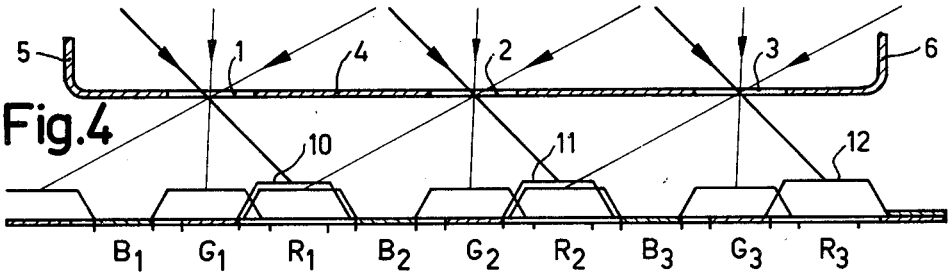
FIGS. 4 and 5 show an exposure method according to the invention.

According to the invention, during the exposure for the blue phosphor lines as shown in FIG. 4, exposure is also carried out from an extra position as a result of which the light distributions 10, 11 and 12 are formed. The light distributions 10 and 11 coincide substantially with areas which are already exposed from the other positions but the light distribution 12 exposes the area $R_3$ so that at that area no blue phosphor can be developed. The extra exposure position during the exposure for the blue phosphor lines is present substantially in the exposure centre for the red phosphor lines.

Figure 5:
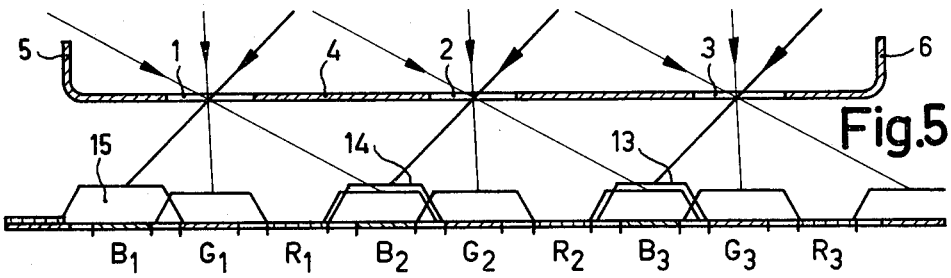

During the exposure for the red phosphor lines as shown in FIG. 5, exposure is also carried out from an extra position so that the light distributions 13, 14 and 15 are formed. The light distributions 13 and 14 coincide substantially with areas which are already exposed from the other positions, but the light distribution 15 exposes the area $B_1$ so that no red phosphor can be developed at that area. The extra exposure position during the exposure for the red phosphor lines is present substantially in the exposure centre for the blue phosphor lines.

As already stated, a suitable method of providing a phosphor pattern on the unexposed areas of a photosensitive layer is an electrophotographic method. Such a method is disclosed in U.S. Pat. No. 3,475,169 and therefore requires only a brief explanation. A firable conductive layer is provided on the window of the display screen and then a firable photoconductive layer is provided. The photoconductive layer is then given a negative surface charge by means of a corona discharge of electrodes which have a potential of, for example, −30 kV relative to the conductive layer. The photoconductive layer is then exposed according to the desired pattern so that the negative charge is maintained only in the unexposed places. The photoconductive layer is then developed by means of a suspension of positively charged phosphor particles which deposit on the pattern of unexposed areas of the photoconductive layer.

What is claimed is:

1. A method of manufacturing a cathode ray tube for displaying coloured pictures and comprising a display screen having a large number of triplets each consisting of three linear areas luminescing in a first, a second and a third colour, respectively, said second colour being present between the first and the third colour, means to generate three electron beams, and a colour selection electrode comprising a large number of substantially parallel slots for assigning each electron beam to luminescent areas of one colour, in which method for providing the luminescent regions of each colour a photosensitive layer is exposed through the colour selection electrode from at least two positions present one on each side of an exposure centre for said colour in such manner that the light beams which pass through two adjacent slots overlap each other on the photosensitive layer and an unexposed area where the luminescent areas of the said colour are provided is formed on the photosensitive layer between the light beams which pass through the same slot, characterized in that during the exposure for providing the luminescent areas of the third colour at the edge of the display screen the photosensitive layer is also exposed from substantially the exposure centre for the first colour and that during the exposure for providing the luminescent areas of the first colour at the edge of the display screen, the photosensitive layer is also exposed from substantially the exposure centre for the third colour.

2. A cathode ray tube for displaying coloured pictures manufactured according to a method as claimed in claim 1.

* * * * *